US012246888B2

(12) United States Patent
Kim

(10) Patent No.: US 12,246,888 B2
(45) Date of Patent: Mar. 11, 2025

(54) INTERLOCKING STRUCTURE OF BOTTOM SURFACE PORTION OF PAPER BOX

(71) Applicant: CJ CHEILJEDANG CORPORATION, Seoul (KR)

(72) Inventor: Myung Jae Kim, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 0 days.

(21) Appl. No.: 17/286,938

(22) PCT Filed: Jan. 19, 2021

(86) PCT No.: PCT/KR2021/000732
§ 371 (c)(1),
(2) Date: Apr. 20, 2021

(87) PCT Pub. No.: WO2022/107996
PCT Pub. Date: May 27, 2022

(65) Prior Publication Data

US 2023/0348129 A1 Nov. 2, 2023

(30) Foreign Application Priority Data

Nov. 17, 2020 (KR) ..... 10-2020-0153952

(51) Int. Cl.
*B65D 5/10* (2006.01)

(52) U.S. Cl.
CPC ..... *B65D 5/10* (2013.01)

(58) Field of Classification Search
CPC ..... B65D 5/10–106
USPC ..... 229/117, 183–185
See application file for complete search history.

(56) References Cited

U.S. PATENT DOCUMENTS 2,970,740 A * 2/1961 Fowle ..... B65D 5/3621 229/152
3,517,875 A * 6/1970 Donavon ..... B65D 5/3621 229/117.34
4,291,828 A * 9/1981 Nigro ..... B65D 5/3621 229/117
4,856,705 A * 8/1989 Carr ..... B65D 5/3614 229/117
4,981,254 A * 1/1991 Depper ..... B65D 5/46088 229/117.14

(Continued)

FOREIGN PATENT DOCUMENTS

CN 208412675 U 1/2019
CN 212667919 U 3/2021

(Continued)

OTHER PUBLICATIONS

Cj-Cheiljedang Corp., Commercial Invoice, 2020, pp. 1-7.

(Continued)

*Primary Examiner* — Nathan J Newhouse
*Assistant Examiner* — Phillip D Schmidt
(74) *Attorney, Agent, or Firm* — CANTOR COLBURN LLP

(57) ABSTRACT

The present invention is to provide an interlocking structure of a bottom surface portion of a paper box, in which the interlocking force between the bottom surface plates constituting the bottom surface portion of the paper box is improved, thereby improving durability of a bottom surface.

2 Claims, 9 Drawing Sheets

(56) References Cited

U.S. PATENT DOCUMENTS

| | | | | | |
|---|---|---|---|---|---|
| 5,042,714 | A * | 8/1991 | Hall | B65D 5/3621 229/117 |
| 5,927,593 | A * | 7/1999 | Berkowitz | B65D 5/0281 229/117 |
| 7,841,511 | B2 * | 11/2010 | Fogle | B65D 5/0281 229/185 |
| 9,617,032 | B2 * | 4/2017 | Gamble | B65D 5/5038 |
| 2009/0121004 | A1 * | 5/2009 | Fogle | B65D 5/0281 229/148 |
| 2014/0024510 | A1 * | 1/2014 | Little | B65D 5/103 493/183 |

FOREIGN PATENT DOCUMENTS

| | | | | |
|---|---|---|---|---|
| DE | 202012003954 | U1 * | 9/2013 | B65D 5/0227 |
| EP | 0462947 | A1 | 12/1991 | |
| EP | 2465785 | A1 * | 6/2012 | B65D 5/0254 |
| EP | 3453634 | A1 * | 3/2019 | B65D 5/061 |
| EP | 3689769 | A1 | 8/2020 | |
| JP | S58190170 | U | 12/1983 | |
| JP | h0435515 | | 3/1992 | |
| JP | 2004231301 | A | 8/2004 | |
| JP | 2006069564 | A | 3/2006 | |
| JP | 2006069566 | A | 3/2006 | |
| JP | 6125856 | B2 | 5/2017 | |
| KR | 101862365 | B1 | 5/2018 | |
| KR | 20230120469 | A * | 8/2023 | |

OTHER PUBLICATIONS

International Search Report for PCT/KR2021/000732 mailed on Jul. 30, 2021.

Korean Office Action for Application No. 10-2020-0153952 dated Jan. 27, 2021.

JP Office Action for Patent Application No. 2021-538686 dated May 15, 2023; 10 pages.

Taiwanese office action for Application No. 110117101 dated Feb. 9, 2022.

Taiwanese Search Report for Application No. 110117101 dated Jan. 25, 2022.

Japanese Office Action dated Nov. 13, 2023, issued in corresponding JP Patent Application No. 2021-538686 (with translation) (6 pages).

* cited by examiner

INTERLOCKING STRUCTURE OF BOTTOM SURFACE PORTION OF PAPER BOX

TECHNICAL FIELD

The present invention relates to an interlocking structure of a bottom surface portion of a paper box, in which an interlocking force between bottom surface plates constituting the bottom surface portion of the paper box is improved, and durability of the bottom surface portion is improved.

BACKGROUND ART

Conventional paper boxes are delivered in an unfolded form to minimize a volume and are assembled to use at the manufacturing site. For the efficiency of an assembly process, the paper boxes are manufactured as easy to assemble as possible. However, in general, if it is easy to assemble, it is easily disassembled because the interlocking force of the paper box is low, and if it is difficult to assemble, it is difficultly disassembled because the interlocking force of the paper box is high. In particular, as the weight of the contents increases, this phenomenon is more prominent, and when the contents are distributed, the loosening of the interlocking or the opening of the bottom occurs. In order to solve this problem, bottom pad is also placed inside the paper box. However, this solution is not a fundamental solution because the unit price increases, the assembly process is added, and the improvements are limited.

As an example, FIG. 1 is a view showing a part of a circumferential surface portion 10 and a bottom surface portion 20 in an expanded view of a paper box according to the prior art.

The bottom surface portion 20 of the paper box according to the prior art may include a bottom surface plate 30 and a flip plate 40. In detail, the bottom surface plate 30 may include a front bottom surface plate 30*a* and a rear bottom surface plate 30*b*, and the flip plate 40 may include one flip plate 40*a* and an other flip plate 40*b*. In this case, the front bottom surface plate 30*a*, the one flip plate 40*a*, the rear bottom surface plate 30*b*, and the other flip plate 40*b* may be sequentially positioned, and the front bottom surface plate 30*a*, one flip plate 40*a*, the rear bottom surface plate 30*b* and the other flip plate 40*b* may be connected to a front plate 12, an one side plate 14, a rear plate 16, and an other side plate 18, respectively.

FIGS. 2 and 3 are views showing a process of assembling the bottom surface portion 20 of the paper box of FIG. 1. FIG. 4 is a view showing the bottom surface portion 20 viewed from the top to the bottom in a state in which the paper box of FIG. 1 has been assembled.

A bottom surface plate 30 constituting the bottom surface portion 20 has a coupling structure in which the front bottom surface plate 30*a* and the rear bottom surface plate 30*b* are interlocked with each other to be fastened. The bottom surface plate 30 has a protruding head portion 32 for locking. In addition, a rear outer periphery of the protruding head portion 32 include an inclined portion 52 and a locking end 54.

In the case of a paper box according to the prior art having such an assembly method, as shown in FIG. 2, a portion where the front bottom surface plate 30*a* and the rear bottom surface plate 30*b* primarily contact is the inclined portion 52. The inclined portion 52 has a point contact F. The inclined portion 52 serves as a guide and guides the movement of the front bottom surface plate 30*a* and the rear bottom surface plate 30*b* in contact with each other. Accordingly, the inclined portion 52 guides the portion in contact with each other to the end portion of the inclined portion 52. In this case, because point contact is made between the inclined portions 52, there is a problem that it is not easy to guide the front bottom surface plate 30*a* and the rear bottom surface plate 30*b*.

In addition, as shown in FIGS. 3 and 4, interlocking and fixing between the front bottom surface plate 30*a* and the rear bottom surface plate 30*b* are made by the locking end 54 provided at the end of the inclined portion 52 and formed as a straight section. As a result, the width of the portion where the interlocking and fastening between the front bottom surface plate 30*a* and the rear bottom surface plate 30*b* is made is relatively narrow as shown in W1 of FIG. 4.

Therefore, the conventional paper box has a problem in that the interlocking force between the bottom surface plates 30 is relatively weak and durability is weak.

CONTENT OF DISCLOSURE

Solution to Problem

An object of the present invention is to provide an interlocking structure of a bottom surface portion of a paper box that is easy to assemble, improves the interlocking force between the bottom surface plates constituting the bottom surface portion of the paper box, and improves a durability of the bottom surface portion without an additional bottom surface pad.

In addition, another object of the present invention is to provide a paper box in which the contents are difficult to be forged by a configuration with the width of the locking width between the bottom surface plates is large.

Solution to Problem

An interlocking structure of the bottom surface portion of the paper box according to an embodiment of the present invention may include a circumferential surface portion forming a circumferential surface of the paper box, and a bottom surface portion connected to a lower side of the circumferential surface portion via a fold line between the bottom surface portion and the circumferential surface portion, and forming the bottom surface of the paper box, wherein the bottom surface portion may include a first bottom surface plate, a first bottom surface flip plate, a second bottom surface plate, and a second bottom surface flip plate which are positioned in sequence, each of the first bottom surface plate and the second bottom surface plate may include a protruding head portion forming a front portion of the bottom surface plate, a body portion forming a rear portion of the bottom surface plate, and an interlocking groove provided between the protruding head portion and the body portion, the protruding head portion may have a first width in a vertical direction, the body portion has a second width in the vertical direction, and the interlocking groove has a third width in the vertical direction, and the sizes of the first width, the second width, and the third width may have a relationship of the first width>the second width>the third width.

According to an embodiment, the protruding head portion may include a first straight section forming a lower outer periphery of the protruding head portion, and a second straight section forming a rear outer periphery of the protruding head portion.

According to an embodiment, an inclined portion may be provided between the first straight section and the second straight section.

According to an embodiment, the first straight section and the second straight section may be orthogonal to each other.

According to an embodiment, the interlocking groove may include a third straight section forming a lower outer periphery of the interlocking groove.

According to an embodiment, the protruding head portion may include a second straight section forming a rear outer periphery of the protruding head portion, and the second straight section and the third straight section are orthogonal to each other.

According to an embodiment, between a lower outer peripheral portion of the interlocking groove and the lower outer peripheral portion of the body portion, a step portion may be provided.

Advantageous Effects of Disclosure

The interlocking structure of a bottom surface portion of a paper box according to the present invention allows bottom surface plates to be in line contact with each other during an assembly process, thereby providing a stable guide.

In the bottom surface plates of the bottom surface portion of the paper box according to the present invention, protruding head portions protrude deeply inward from each other, so that durability of the bottom surface portion may be improved.

The bottom surface plate of the bottom surface portion of the paper box according to the present invention includes an interlocking groove between the protruding head portion and a body portion, and has a configuration in which the length of the straight section forming a rear outer periphery portion of the protruding head portion is increased and the width of the protruding head portion is large. Accordingly, the interlocking force between the bottom surface plates may be increased, and durability may be improved. In addition, when contents are forcibly taken out from the bottom surface, the bottom surface is damaged, making it difficult to forge the contents.

The interlocking structure of the bottom surface portion of the paper box according to the present invention enables assembly and shape configuration of the paper box using a machine. Therefore, manpower is saved and it is advantageous in the manufacturing process.

DETAILED DESCRIPTION

Hereinafter, preferred embodiments of the present invention will be described with reference to the accompanying drawings.

Hereinafter, the front, rear, left and right directions will be described based on the front, rear, left and right directions shown in FIG. 5.

Figure 1:
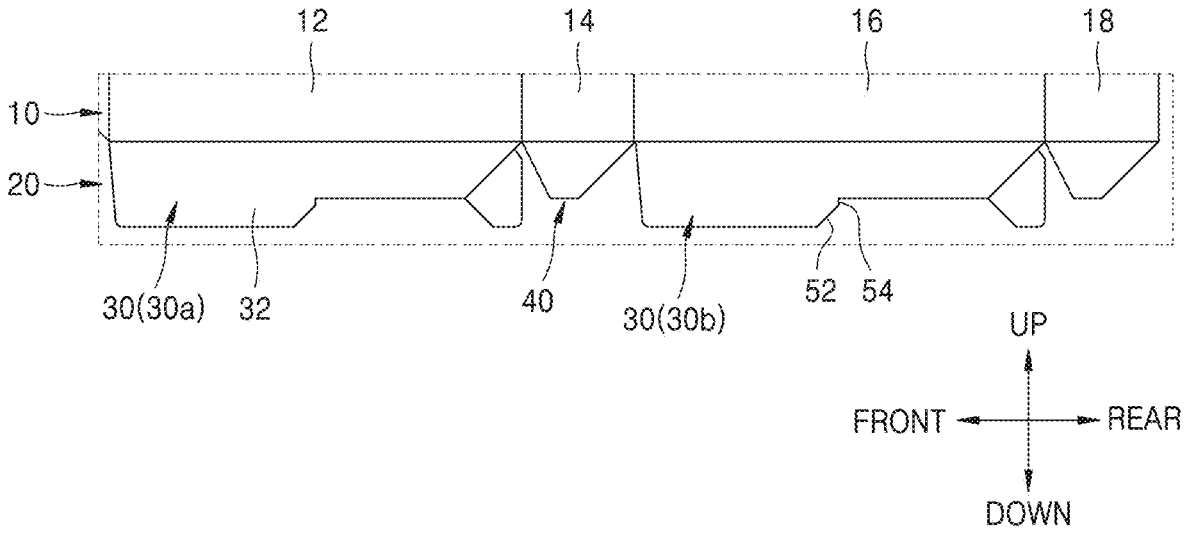
FIG. 1 is an exploded view showing a part of a circumferential surface portion and a bottom surface portion in an unfolded state of the paper box according to the prior art.
Figure 2:
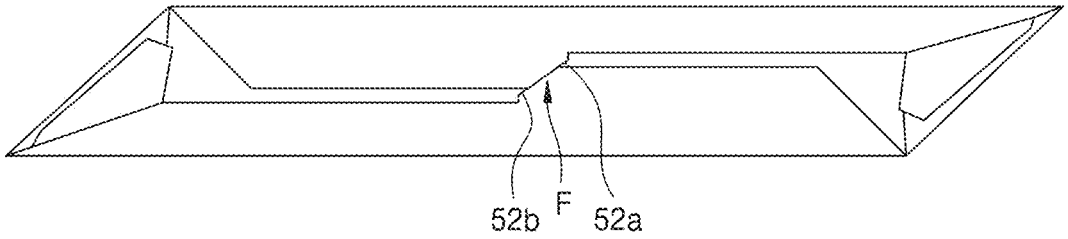
FIGS. 2 and 3 are views illustrating a process of assembling a bottom surface portion of the paper box of FIG. 1.
Figure 3:
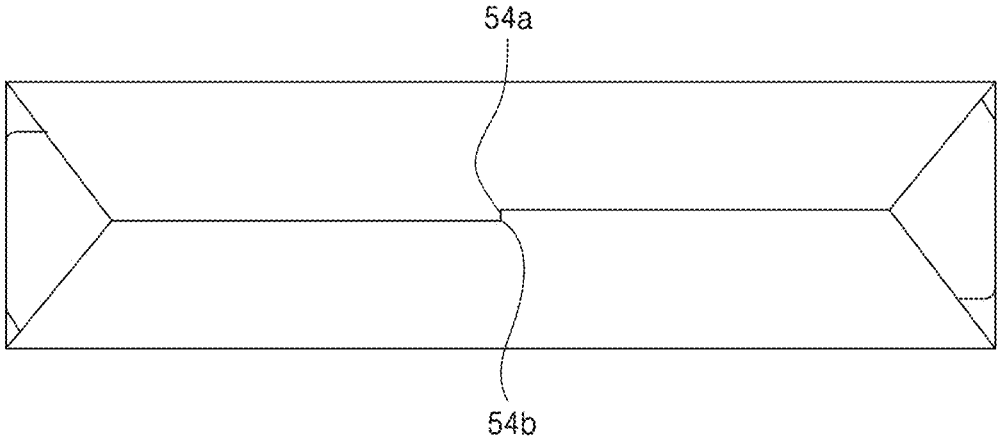
Figure 4:
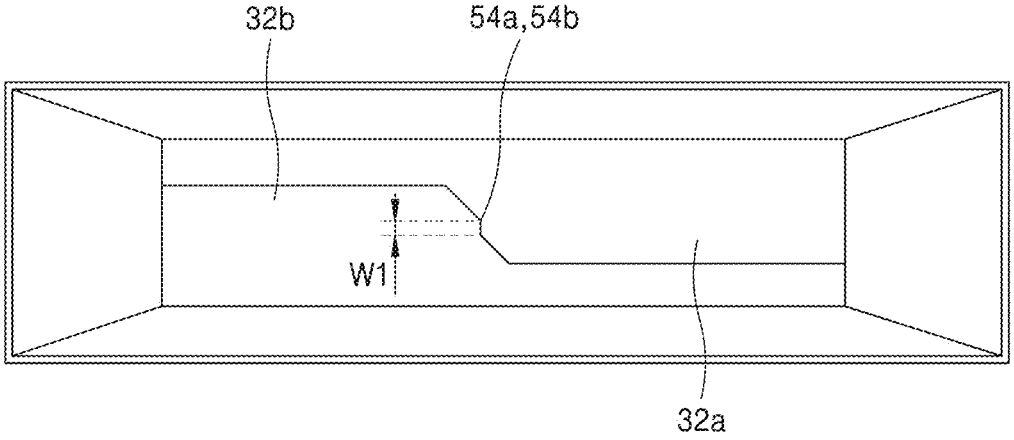
FIG. 4 is a view showing a bottom surface portion viewed from top to bottom in a state in which the paper box of FIG. 1 is assembled.
Figure 5:
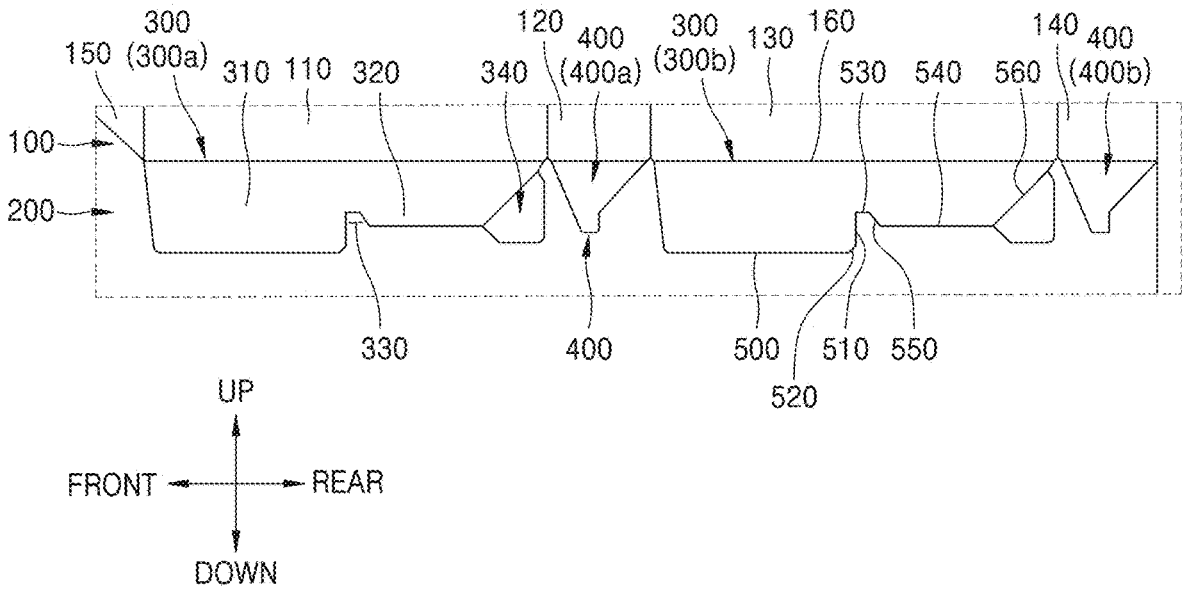
FIG. 5 is an exploded view showing a part of a circumferential surface portion and a bottom surface portion in an unfolded state of a paper box having an interlocking structure of a bottom surface portion according to an embodiment of the present invention.

FIG. 5 is an exploded view showing a part of a circumferential surface portion 100 and a bottom surface portion 200 in an unfolded state of a paper box having an interlocking structure of the bottom surface portion according to an embodiment of the present invention.

The paper box having interlocking structure of a bottom surface portion according to the present invention includes the circumferential surface portion 100 and the bottom surface portion 200.

The circumferential surface portion 100 forms the circumferential surface of the paper box. The circumferential surface portion 100 may include, for example, a front plate 110, one side plate 120, a rear plate 130, and the other side plate 140. Here, the one side plate 120 may be, for example, a left side plate, and the other side plate 140 may be a right side plate, but is not limited thereto.

The front, rear, left, and right directions as described above are not necessarily limited, and may be named differently according to different front and rear directions and side directions. The front plate 110, one side plate 120, the rear plate 130, and the other side plate 140 may be connected with a foldable fold line therebetween.

In addition, at least one of the front end and the rear end of the circumferential surface portion 100 may be provided with an adhesive surface portion 150 for connection between the front end and the rear end of the circumferential surface portion 100.

The bottom surface portion 200 forms the bottom surface of the paper box. That is, the bottom surface portion 200 may forms the bottom surface of the paper box when the paper box is folded and assembled.

The bottom portion 200 includes a bottom surface plate 300 and a bottom surface flip plate 400. The bottom surface plate 300 and the bottom surface flip plate 400 are each provided with two. Accordingly, the bottom surface plate 300 includes a first bottom surface plate 300*a* and a second bottom surface plate 300*b*, and the bottom surface flip plate 400 includes a first bottom surface flip plate 400*a* and a second bottom surface plate 400*b*. The bottom surface plate 300 and the bottom surface flip plate 400 are alternately positioned with each other. Accordingly, the first bottom surface flip plate 400*a* is positioned between the first bottom surface plate 300*a* and the second bottom surface plate 300*b*, and the second bottom surface plate 300*b* is positioned between the first bottom surface flip plate 400*a* and the second bottom surface flip plate 400*b*.

For example, assuming that the circumferential surface portion 100 constituting the paper box is composed of the front plate 110, the one side plate 120, the rear plate 130, and the other side plate 140, the first bottom surface plate 300*a* may be provided under the front plate 110, the first bottom surface flip plate 400*a* may be provided under the one side plate 120, the second bottom surface plate 300*b* may be provided under the rear plate 130, and the second bottom surface flip plate 400*b* may be provided under the other side plate 140.

The first bottom surface plate 300*a* and the second bottom surface plate 300*b* may have substantially the same configuration. That is, the first bottom surface plate 300*a* and the second bottom surface plate 300*b* may have a common element. In addition, the first bottom surface flip plate 400*a* and the second bottom surface flip plate 400*b* may have substantially the same configuration. That is, the first bottom surface flip plate 400*a* and the second bottom surface flip plate 400*b* may have a common element. For convenience, hereinafter, it will be consistently described as "bottom surface plate 300" and "bottom surface flip plate 400". For example, in the following, a description of "the bottom surface plate 300 includes a protruding head portion 310 and a body portion 320" may be understood as a description "the first bottom surface plate 300*a* and the second bottom surface plate 300*b* both include the protruding head portion 310 and the body portion 320".

The bottom surface plate 300 includes a protruding head portion 310 and a body portion 320. The protruding head portion 310 constitutes a front portion of the bottom surface plate 300 and protrudes further downward than the body portion 320. The body portion 320 constitutes a rear portion of the bottom surface plate and is recessed upward compared to the protruding head portion 310. That is, a width between upper and lower portions of the protruding head portion 310 is greater than a width between upper and lower portions of the body portion 320.

In addition, an interlocking groove 330 is provided between the protruding head portion 310 and the body portion 320. The interlocking groove 330 is deeply recessed upward compared to the protruding head portion 310 and the body portion 320. That is, a width between upper and lower portions of the interlocking groove 330 is smaller than the width between upper and lower portions of the body portion 320.

That is, the width between a fold line 160 forming the boundary between the circumferential surface portion 100 and the bottom surface plate 300 and a lower outer circumferential portion of the bottom surface plate 300 has an order of size of the protruding head portion 310>body portion 320>interlocking groove 330.

Figure 6:
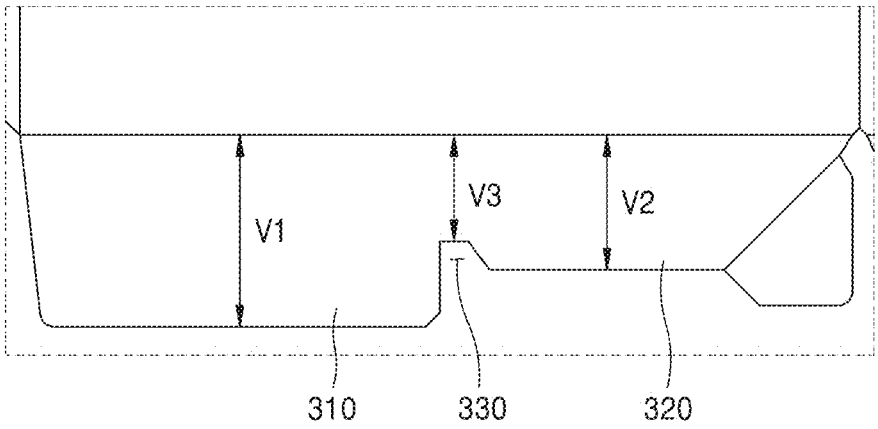
FIG. 6 is an enlarged view of the bottom surface plate of FIG. 5.

In other words, as shown in FIG. 6, the protruding head portion 310 has a first width V1 in the vertical direction, the body portion 320 has a second width V2 in the vertical direction, and the interlocking groove 330 has a third width V3 in the vertical direction. The sizes of the first width V1, the second width V2, and the third width V3 have a relationship of the first width V1>the second width V2>the third width V3.

A lower outer periphery of the protruding head portion 310 may include a first straight section 500. In this case, the first straight section 500 may be parallel to the fold line 160, which is a line connecting the circumferential surface portion 100 and the bottom surface plate 300.

A rear outer periphery of the protruding head portion 310 may include a second straight section 510. The second straight section 510 may be orthogonal to the fold line 160, which is a line connecting the circumferential surface portion 100 and the bottom surface plate 300. However, it is not necessarily limited thereto.

An inclined surface portion 520 may be provided between the first straight section 500 and the second straight section 510. That is, a rear edge of the protruding head portion 310 may be configured with the inclined surface portion 520 having a chamfer structure. Here, the inclined surface is not necessarily limited to a straight inclined surface, and may be a curved surface having a curvature.

A lower outer periphery of the interlocking groove 330 may include a third straight section 530. The third straight section 530 may be parallel to the fold line 160, which is a line connecting the circumferential portion 100 and the bottom surface plate 300. However, it is not necessarily limited thereto.

The second straight section 510 and the third straight section 530 may be orthogonally connected to each other. That is, the edge between the rear outer periphery of the protruding head portion 310 and the lower outer periphery of the interlocking groove 330 may be a right angle. However, it is not necessarily limited thereto.

A lower outer periphery of the body portion 320 may include a fourth straight section 540. The fourth straight section 540 may be parallel to the fold line 160, which is a line connecting the circumferential surface portion 100 and the bottom surface plate 300. However, it is not necessarily limited thereto.

Between the third straight section 530 and the fourth straight section 540, a step portion 550 generated by a vertical distance difference between the third straight section 530 and the fourth straight section 540 may be provided. The step portion 550 may be configured as an inclined surface having a predetermined inclination angle. Here, the inclination angle means that when the third straight section 530 and/or the fourth straight section 540 is a horizontal line in the relationship with the third straight section 530 and/or the fourth straight section 540, the step portion 550 has a predetermined intervening angle (tilt angle).

The bottom surface plate 300 may further include a side flip portion 340. The side flip portion 340 is provided to be foldable at the rear side of the body portion 320. In detail, the side flip portion 340 may be connected to the body portion 320 via a folded portion 560 which is an inclined line between the body portion 320 and the side flip portion 340.

The bottom surface flip plate 400 may be configured as a plate having a triangular shape as a whole. As described above, the bottom surface flip plates 400 may be connected to the one side plate 120 and the other side plate 140 to be foldable, respectively.

Figure 7:
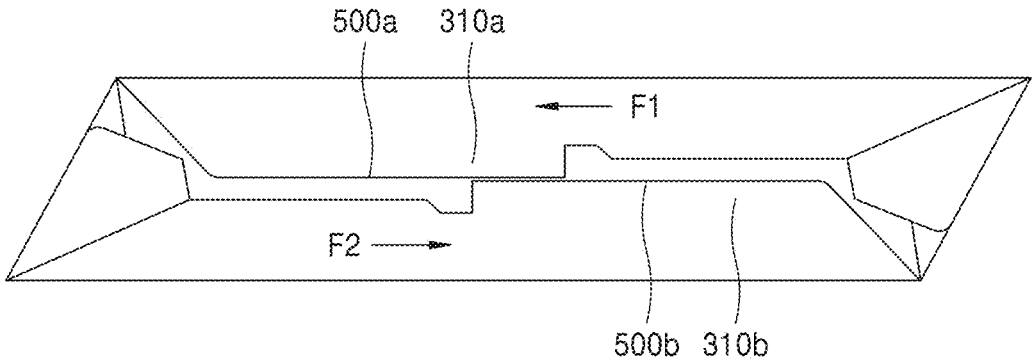
FIGS. 7 and 8 are views showing a process of assembling the bottom surface portion of the paper box of FIG. 5.
Figure 8:
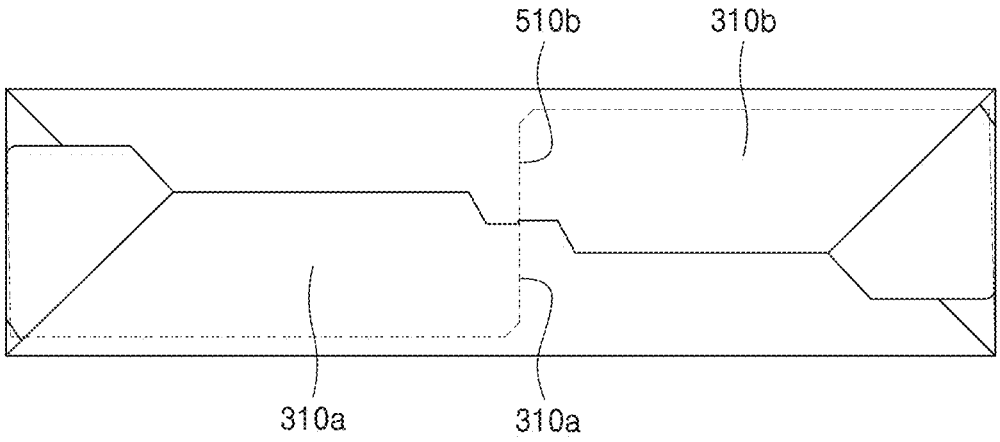
Figure 9:
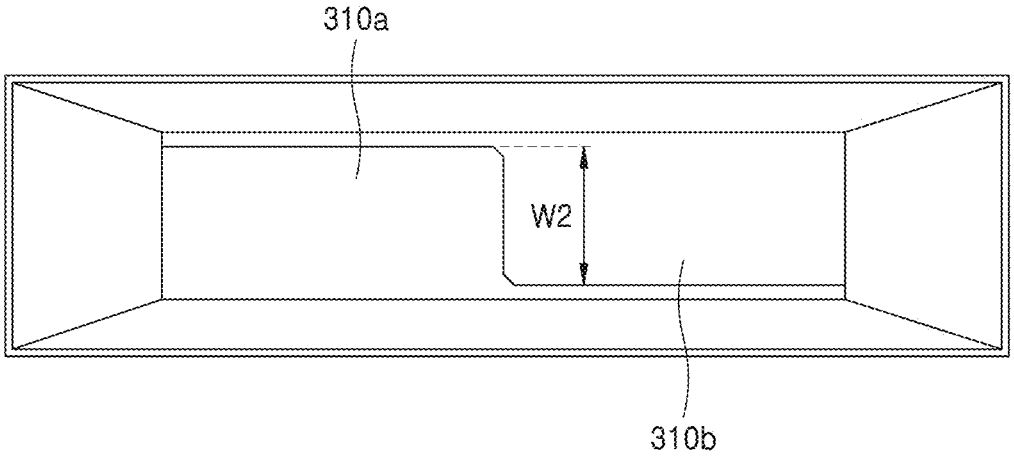
FIG. 9 is a view showing the bottom surface portion viewed from the top to the bottom in a state in which the paper box of FIG. 5 is assembled.

FIGS. 7 and 8 are views showing a process of assembling the bottom surface portion 200 of the box of FIG. 5. FIG. 9 is a view showing the bottom surface portion 200 viewed from the top to the bottom in a state in which the paper box of FIG. 5 is assembled.

Hereinafter, the assembly of the paper box according to the embodiment of the present invention will be described.

As shown in FIG. 7, in the case of assembling the paper box according to the embodiment of the present invention, when folded along the fold line provided on the circumferential surface portion 100 so that the front plate 110 and the rear plate 130 face each other, first, the first bottom surface plate 300*a* and the second bottom surface plate 300*b* of the bottom surface portion 200 primarily contact each other. In this case, a portion where the first bottom surface plate 300*a* and the second bottom surface plate 300*b* contact each other is the first straight section 500. That is, as a first straight section 500*a* of the first bottom surface plate 300*a* and a first straight section 500*b* of the second bottom surface plate 300*b* come into contact with each other, the first bottom surface plate 300*a* and the second bottom surface plate 300*b* make at least partially make line contact with each other.

In this state, force is applied as shown by arrows F1 and F2 in FIG. 7. The direction in which the force is applied is a direction in which one side plate 120 and the other side plate 140 are positioned parallel to each other. In this case, because the first bottom surface plate 300*a* and the second bottom surface plate 300*b* are in line contact with each other as described above, a stable guide may be performed.

That is, when the first bottom surface plate 300*a* and the second bottom surface plate 300*b* make point contact, as the contact force is concentrated at one point, there is a possibility of damage, and the effect of guiding the movements of the first and second bottom surface plates 300*a* and 300*b* to each other may be reduced. On the other hand, according to the embodiment of the present invention, because the first bottom surface plate 300*a* and the second bottom surface plate 300*b* are in line contact with each other by the first straight section 500, the contact force is not concentrated at one point, thereby reducing the possibility of damage, and movements of the first bottom surface plate 300*a* and the second bottom surface plate 300*b* may be naturally guided.

Next, as shown in FIG. 8, when the rear outer circumferential portions 500*a* and 500*b*, which are the second straight sections, of the protruding head portion portions 310*a* and 310*b* constituting the first bottom surface plate 300*a* and the second bottom surface plate 300*b* reach a position where the end of the first straight section 500*a* of the first bottom surface plate 300*a* and the end of the first straight section 500*b* of the second bottom surface plate 300*b* contact each other, an instantaneous interlocking is made by a drop. That is, the first bottom surface plate 300*a* moves in the direction of the rear plate 130 (lower side), and the second bottom surface plate 300*b* moves in the direction of the front plate 110 (upper side). Accordingly, an interlocking groove 330*a* of the first bottom surface plate 300*a* and an interlocking groove 330*b* of the second bottom surface plate 300*b* come into contact with each other.

In this case, according to the embodiment, the inclined surface portion 520 is provided at a corner position between the first straight section 500 forming the lower outer periphery of the protruding head portion 310 and the second straight section 510 forming the rear outer periphery of the protruding head portion 310. Accordingly, friction or jamming does not occur, and instantaneous interlocking as described above may be stably performed.

In addition, in the interlocked state as described above the protruding head portion 310*a* of the first bottom surface plate 300*a* protrudes deeply into the inside (lower side in FIG. 8) of the second bottom surface plate 300*b*, and the protruding head portion 310*a* of the second bottom surface plate 300*b* protrudes deeply into the inside (upper side in FIG. 8) of the first bottom surface plate 300*a*. That is, the interlocking may be performed as shown in FIGS. 8 and 9. Accordingly, the first bottom surface plate 300*a* and the second bottom surface plate 300*b* may have a large contact area and high interlocking force. Due to such a configuration, durability of the bottom surface portion 200 may be improved.

According to the embodiment, the interlocking groove 330 is formed between the protruding head portion 310 and the body portion 320 and is recessed upward, so that the length of the second straight section 510 forming the rear outer periphery of the protruding head portion 310 is increased.

Accordingly, the size of a locking width W2 between the first bottom surface plate 300*a* and the second bottom surface plate 300*b* may be increased. In order to release the locking between the first bottom surface plate 300*a* and the second bottom surface plate 300*b*, the first bottom surface plate 300*a* and the second bottom surface plate 300*b* must be deformed by the size of the locking width W2. Therefore, an increase in the locking width W2 means that the interlocking force increases. Accordingly, according to the embodiment, the interlocking force between the first bottom surface plate 300*a* and the second bottom surface plate 300*b* is further increased by the configuration in which the locking width W2 is increased.

In addition, as in the embodiment, the width V1 of the protruding head portion 310 is larger than the width V3 of the portion in which the interlocking groove 330 is formed. Accordingly, while the size of the locking width W2 increases, durability of the bottom surface plate 300 may not be lowered at the same time.

In addition, as in the embodiment, the width V1 of the protruding head portion 310 is larger than the width V2 of the body portion 320. Accordingly, while the locking width W2 is further increased, an area covering the bottom increases. Therefore, the durability of the paper box may be improved. That is, durability of the paper box may be improved without adding additional members (e.g., bottom pads).

As a result, even if the weight of the contents is increased, it is possible to minimize loosening of the interlocking or opening of the bottom during distribution.

In addition, the paper box having the interlocking structure of the bottom surface portion of the paper box according to the embodiment of the present invention has a high interlocking force of the bottom surface portion, so it is difficult to take the contents out through the bottom. In addition, because the locking width W2 between the bottom surface plates is large, if the contents are forcibly taken out through the bottom, the paper box is damaged. Therefore, it is possible to prevent forging the contents, and it is possible to easily identify the paper box in which the contents have been forged.

Table 1 below shows a comparison the interlocking force of the paper box having the interlocking structure of the bottom surface portion of the paper box according to the prior art, and the interlocking force of the paper box having the interlocking structure of the bottom surface portion of the paper box according to an embodiment of the present invention. The unit is commonly kgf.

TABLE 1

| | Experiment 1 | Experiment 2 | Experiment 3 | Experiment 4 | Experiment 5 | Average |
|---|---|---|---|---|---|---|
| Prior art | 8.8 | 7.9 | 8.3 | 7.5 | 6.9 | 7.9 |
| The present invention | 20.6 | 18.0 | 19.7 | 19.3 | 20.7 | 19.7 |

As shown in Table 1 above, the interlocking force of the paper box having the interlocking structure of the bottom surface portion of the paper box according to the prior art is 7.9 kgf on average, whereas the interlocking force of the paper box having the interlocking structure of the bottom surface portion of the paper box according to the embodiment of the present invention is 19.7 kgf. That is, it may be seen that the interlocking force is improved compared to the prior art.

Further, according to the interlocking structure of the bottom surface portion of the paper box according to the embodiment of the present invention, the assembly and configuration of the paper box using a machine is more convenient.

That is, in the case of the present invention, it is easy to construct the paper box having a rectangular cross-section by pressing the paper box flatly pressed in a parallelogram shape as shown in FIG. 7 from both sides to the center. This is because the first bottom surface plate 300*a* and the second bottom surface plate 300*b* each have a first straight section 500*a* and a second straight section 500*b* extending in the front-rear direction for a relatively long, so that guides are made in a form in line contact with each other when the first bottom surface plate 300*a* and the second bottom surface plate 300*b* contact each other, and also, because the second straight section 510 extending in the vertical direction is coupled to each other when the first bottom surface plate 300*a* and the second bottom surface plate 300*b* are coupled. On the other hand, in the case of the prior art without such a straight section or relatively short, when the bottom surface plates 300 are coupled, the guiding effect and the interlocking force between the bottom surface plates 300 are relatively insufficient, and thus a manpower input is required in the assembly process. Therefore, in the case of the present invention, a mechanical process may be applied in the assembly, and the manufacturing cost is reduced.

In the above, preferred embodiments have been illustrated and described, but the present invention is not limited to the embodiments described above, and various modifications may be implemented by those of ordinary skill in the art to which the present invention belongs without departing from the gist of the present invention claimed in the claims, and these various modifications should not be individually understood from the technical idea or perspective of the present invention.

EXPLANATION OF REFERENCE NUMERALS DESIGNATING THE MAJOR ELEMENTS OF THE DRAWINGS

10: circumferential surface portion
12: front plate
14: one side plate
16: rear plate
18: other side plate
20: bottom surface portion
30: bottom surface plate
30*a*: front bottom surface plate
30*b*: rear bottom surface plate
32: protruding head portion
40*a*: one side flip plate
40*b*: other flip plate
40: flip plate
52: inclined portion
54: locking end
100: circumferential surface portion
110: front plate
120: one side plate
130: rear plate
140: other side plate
150: adhesive surface portion
160: fold line
200: bottom surface portion
300: bottom surface plate
300*a*: first bottom surface plate
300*b*: second bottom surface plate
310: protruding head portion
320: body portion
330: interlocking groove
340: side flip portion
400: flip plate
400*a*: first bottom surface flip plate
400*b*: second bottom surface flip plate
500: first straight section
500*a*: first straight section
500*b*: first straight section
510: second straight section
520: inclined surface portion
530: third straight section
540: fourth straight section
550: step portion
560: folded portion

The invention claimed is:

1. An interlocking structure of a bottom surface portion of a paper box, the interlocking structure comprising:

a circumferential surface portion forming a circumferential surface of the paper box, and a bottom surface portion connected to a lower side of the circumferential surface portion via a fold line between the bottom surface portion and the circumferential surface portion, and forming the bottom surface of the paper box, wherein the bottom surface portion includes a first bottom surface plate, a first bottom surface flip plate, a second bottom surface plate, and a second bottom surface flip plate which are positioned in sequence, each of the first bottom surface plate and the second bottom surface plate includes a protruding head portion forming a front portion of the bottom surface plate, a body portion forming a rear portion of the bottom surface plate, and an interlocking groove provided between the protruding head portion and the body portion, the protruding head portion has a first width in a vertical direction, the body portion has a second width in the vertical direction, and the interlocking groove has a third width in the vertical direction, and the sizes of the first width, the second width, and the third width have a relationship of the first width>the second width>the third width;

the protruding head portion includes:

a first straight section forming a lower outer periphery of the protruding head portion; and a second straight section forming a rear outer periphery of the protruding head portion, an inclined portion is provided between the first straight section and the second straight section, the first straight section and the second straight section are orthogonal to each other, the interlocking groove includes a third straight section forming a lower outer periphery of the interlocking groove, the body portion includes a fourth straight section extending in a front and rear direction at a height corresponding to a point between an upper end and a lower end of the second straight section, the second straight section has one side end connected to the third straight section, and has a length greater than at least a vertical interval between the third straight section and the fourth straight section, a width of the third straight section is less than a width of the fourth straight section, when the paper box is assembled, the paper box has a rectangular cross-section by pressing the paper box flatly pressed in a parallelogram shape from both sides to a center, when folded along a fold line provided on the circumferential surface portion so that a front plate and a rear plate face each other, the first straight sections of the first bottom surface plate and the second bottom surface plate of the bottom surface portion contact parallel each other, the first bottom surface plate and the second bottom surface plate are in line contact with each other, and a stable guide between the first bottom surface plate and the second bottom surface plate is achieved, and when the rear outer circumferential portions of the protruding head portion reach a position contacting each other, an instantaneous interlocking is made by a drop and the second straight sections are locked each other.

2. The interlocking structure of claim 1, wherein between a lower outer peripheral portion of the interlocking groove and a lower outer peripheral portion of the body portion, a step portion is provided.

* * * * *